US009961987B1

(12) United States Patent
Harper

(10) Patent No.: US 9,961,987 B1
(45) Date of Patent: May 8, 2018

(54) APPARATUS FOR HANDS-FREE TRANSPORT OF AN ELONGATED NARROW OBJECT

(71) Applicant: Toney Harper, Heflin, LA (US)

(72) Inventor: Toney Harper, Heflin, LA (US)

( * ) Notice: Subject to any disclaimer, the term of this patent is extended or adjusted under 35 U.S.C. 154(b) by 0 days. days.

(21) Appl. No.: 15/498,887

(22) Filed: Apr. 27, 2017

(51) Int. Cl.
*A45F 3/14* (2006.01)
*A45F 3/12* (2006.01)
*A45F 3/04* (2006.01)
*A45B 11/02* (2006.01)

(52) U.S. Cl.
CPC ..... *A45F 3/047* (2013.01); *A45F 3/12* (2013.01); *A45B 11/02* (2013.01); *A45F 3/14* (2013.01); *A45F 2003/142* (2013.01)

(58) Field of Classification Search
CPC ..... A45F 3/14; A45F 2003/142; A45B 11/02
USPC ..... 224/186, 190, 627, 251, 259, 250, 913, 224/922; D3/229
See application file for complete search history.

(56) References Cited

U.S. PATENT DOCUMENTS 4,483,380 A * 11/1984 Beran ..... A45C 3/00 206/315.1
4,628,628 A * 12/1986 Burgin ..... A01K 97/06 206/315.11
4,673,118 A * 6/1987 Kronz ..... A63C 11/025 224/259
5,350,096 A * 9/1994 Sieber ..... A45F 3/14 224/153
5,353,977 A * 10/1994 Schiro, Jr. ..... A45B 11/02 135/16
5,425,194 A * 6/1995 Miller ..... A01K 97/08 206/315.11
5,513,786 A * 5/1996 Drane ..... A45B 11/02 135/34.2
5,829,656 A * 11/1998 Reitz ..... B62B 9/26 224/250
5,860,573 A * 1/1999 Hossack ..... B60R 7/06 211/64
6,206,261 B1 * 3/2001 McCrary ..... B60R 7/14 206/315.11
6,237,820 B1 * 5/2001 Saxton ..... A45F 3/16 215/395
6,267,425 B1 * 7/2001 Dorsey ..... A01K 97/08 211/70.8
D624,367 S * 9/2010 Burton ..... D7/624.2
7,971,763 B2 * 7/2011 Chace ..... A45F 5/14 224/153
7,976,088 B1 * 7/2011 Diciolla ..... A45C 13/30 294/154
2006/0207161 A1 * 9/2006 Lynn ..... A01K 97/08 43/21.2
2008/0041900 A1 * 2/2008 Leifermann ..... A45B 11/00 224/407
2008/0047989 A1 * 2/2008 Sutphin ..... A45F 3/14 224/222

(Continued)

*Primary Examiner* — Justin Larson
(74) *Attorney, Agent, or Firm* — Patrick L. Mixon

(57) ABSTRACT

The present invention teaches a transport device for transporting elongated narrow object in a hands-free manner. The apparatus uses a transport device having three contiguous sides forming an open channel. The elongated narrow object is secured to the channel using one or more binding straps. The transport device may be worn on a wearer's back during transport.

10 Claims, 8 Drawing Sheets

(56) References Cited

U.S. PATENT DOCUMENTS

| | | | | |
|---|---|---|---|---|
| 2011/0174857 | A1* | 7/2011 | King | A45F 3/14<br>224/602 |
| 2012/0273533 | A1* | 11/2012 | Boden | A45B 11/02<br>224/190 |
| 2012/0277034 | A1* | 11/2012 | Mancinelli | A63B 55/00<br>473/409 |
| 2012/0292353 | A1* | 11/2012 | Andersen | A45F 3/06<br>224/149 |
| 2013/0313295 | A1* | 11/2013 | Jacquette | A45B 11/02<br>224/190 |
| 2014/0054336 | A1* | 2/2014 | Rodriguez | A45F 3/14<br>224/250 |

* cited by examiner

APPARATUS FOR HANDS-FREE TRANSPORT OF AN ELONGATED NARROW OBJECT

FIELD OF INVENTION

The present invention relates generally to an apparatus for hands-free transport of elongated narrow objects. More specifically, the present invention relates to a transport device wearable by a human being, on a human being's shoulders and back, the transport device permitting the human wearer to carry an elongated narrow object.

BACKGROUND OF INVENTION

In some instances, it may be necessary to transport a narrow elongated object when your hands are otherwise occupied, or there is a need to keep your hands-free for performing other tasks. Prior art hands-free transportation devices are typically a back pack-type (sack-like) design, such as those disclosed in U.S. Pat. No. 9,578,953 issued Feb. 28, 2017 to He-Jen Chueh. The '953 patent discloses various embodiments of a sack-like transport device suitable for transporting small manageable items that easily fit therein. Such conventional sack-like transport devices are typically secured to a wearer's back using a pair of arm straps affixed to the sack. The wearer need only insert each arm into the arm strap, and the back pack may be worn on the users back, thereby keeping the wearers hand free to perform other tasks.

Unfortunately, sack-like back pack transport devices are not suitable for transporting elongated objects with dimensions that exceed the length or width of the sack. Conventionally, a user wanting to transport an elongated object must use his hands. What is needed is a method for hands-free transport of an elongated narrow object.

SUMMARY OF INVENTION

The present invention provides a transport device suitable for transporting narrow elongated objects that ensures that the wearer's hands remain free to perform multiple tasks. In one aspect, the transport device may be secured on a wearer's back using arm straps. The invention may include a first arm strap for insertion of a wearer's right arm and a second arm strap for inserting a wearer's left arm. In this way, the transport device may be secured on the wear's back, midway between each of the wearer's right and left shoulders.

In another aspect, the transport device includes an elongated member having a first elongated side, and a second elongated side contiguous with said first elongated side. The transport device further includes a third elongated side contiguous with said first elongated side, such that the first elongated side, the second elongated side, and the third elongated side form an elongated channel for accepting a narrow elongated object therein.

In another aspect, the transport device includes a malleable material interspersed within the elongated channel created by the first elongated side, second elongated side, and third elongated side. In one aspect, the malleable material may be used for dampening vibrations resulting from transporting a narrow object within the channel.

In yet another aspect, the transport device includes one or more binding straps for securely holding the elongated transported object therein. The binding straps may be affixed on a second elongated side of the elongated channel, and made to traverse across the elongated channel to fasten securely on the third elongated side of the elongated channel.

In yet another aspect, the transport device traverses lengthwise down a wearer's back when worn.

In yet another aspect, the transport device has one or more body straps securely affixed proximate to a first end of the elongated channel. In an aspect of the invention, a first binding strap may be made to traverse across the elongated channel to fasten securely on the third elongated side of the elongated channel.

BRIEF DESCRIPTION OF DRAWINGS

A more complete understanding of the present invention may be derived be reference to the various embodiments described in the specification, and the drawings and figures in which like numerals denote like elements, and in which.

DETAILED DESCRIPTION

The detailed description of exemplary embodiments and best mode of the invention herein makes reference to the accompanying drawings and figures. While these exemplary embodiments are described in sufficient detail to enable those skilled in the art to practice the invention, it should be understood that other embodiments may be realized and that logical and mechanical changes may be made without departing from the spirit and scope of the invention.

The present invention may be described herein in terms of functional block components and various processing steps. It should be appreciated that such functional blocks may be realized by any number of hardware components configured to perform the specified functions. For example, the present invention may employ various fasteners. The fasteners may be useful for temporarily joining multiple straps. The fasteners described herein may be buckles, snaps, or the like. The fasteners may be of conventional construction suitable for joining multiple straps according to the various embodiments of this invention.

It should be appreciated that the particular implementations shown and described herein are illustrative of the invention and its best mode and are not intended to otherwise limit the scope of the present invention. Indeed, for the sake of brevity, conventional fastener technologies may not be described in detail herein. Furthermore, the connecting lines shown in the figures contained herein are intended to represent exemplary functional relationships and/or physical couplings between the various elements.

Figure 1:
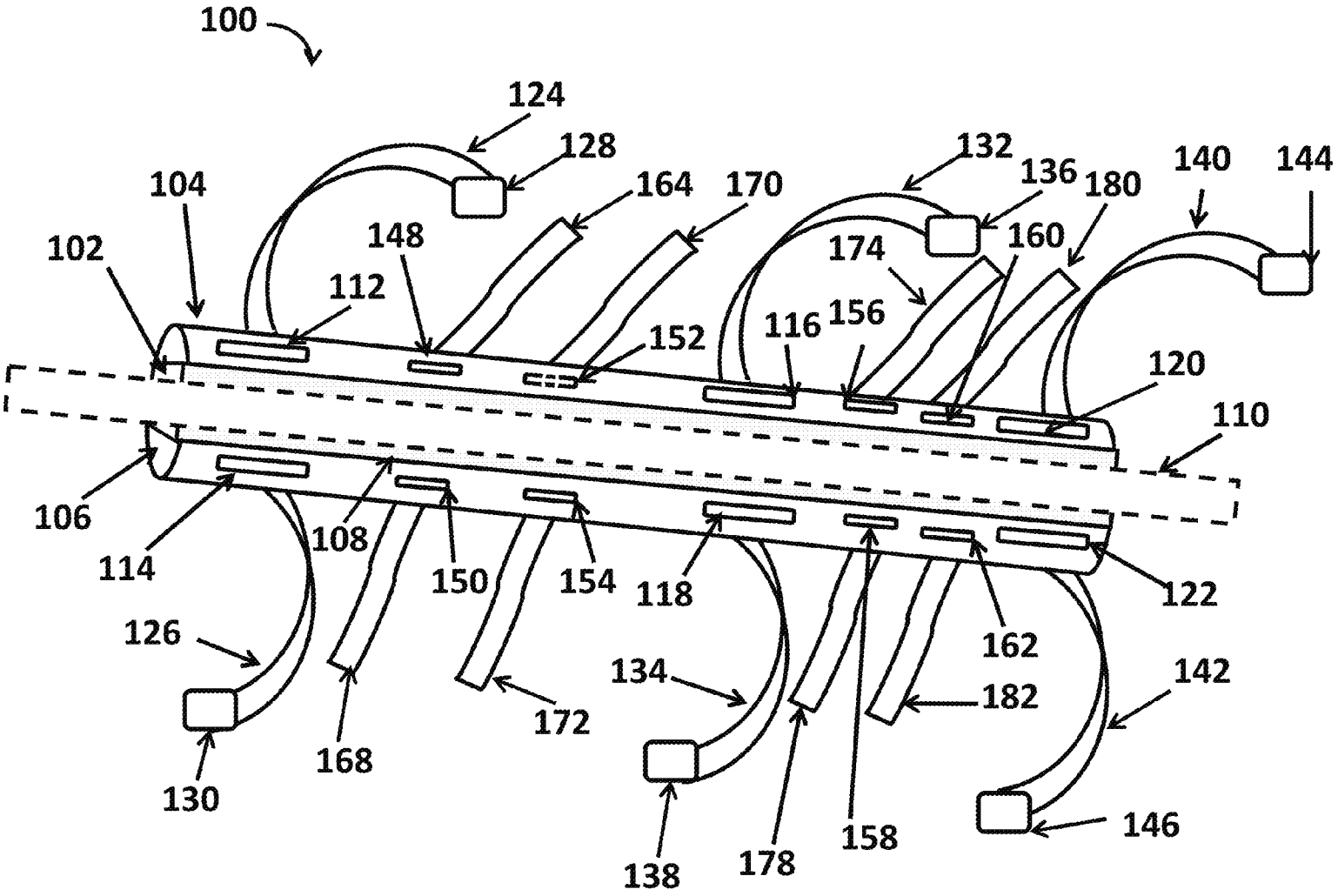
FIG. 1 depicts an exemplary embodiment of a transport device according to the present invention, wherein the transport device includes multiple binding straps.

FIG. 1 depicts an exemplary embodiment of a transport device 100 according to the present invention. As shown, transport device 100 may be comprised of a first elongated side 102, a second elongated side 104 contiguous with first elongated side 102. Transport device 100 may be further comprised of a third elongated side 106, the third elongated side contiguous with the first elongated side 102. The first elongated side 102, second elongated side 104, and third elongated side 106 form an elongated channel 108. In one embodiment, the channel runs directionally along an elongated side of the transport device 100. In one exemplary embodiment, the length of the elongated channel 108 is substantially equal to the length of an elongated side of transport device 100. In yet another embodiment, the length of elongated channel 108 may be substantially equal to first elongated side 102. Alternatively, the length of elongated channel 108 may be substantially equal to second elongated side 104.

In one embodiment, the first elongated side 102, second elongated side 104, and third elongated side 106 may be of substantially equal length. In another exemplary embodiment, only two of the elongated sided may be of substantially equal length. For example, the second elongated side 104 may be of substantially equal length to the third elongated side 106. Further still, the first elongated side 102, second elongated side 104, and third elongated side 106 may be formed in to a single member.

Transport device 100 may be formed such that an elongated narrow rod 110 may be transported within open elongated channel 108. In the exemplary embodiment shown, transport device 100 may include a first adjustable strap 124 affixed to the second elongated side 104 at a first aperture 112 on the second elongated side 104. Transport device 100 may also include a second adjustable strap 132 affixed to the second elongated side 104 at a second aperture 116 on the second elongated side 104.

In the embodiment shown, first adjustable strap 124 may include a fastener 128. Preferably, the fastener 128 may be affixed to first adjustable strap 124 proximate to the end of the adjustable strap 124 opposite the first aperture 112. Second adjustable strap 132 may included a fastener 134. Preferably, the fastener 134 may be affixed to second adjustable strap 132 proximate to the end of the adjustable strap 132 opposite the first aperture 112. In operation, fastener 128 may be releasably coupled to fastener 134, such that a loop is formed when the fastened together. The loop may be of sufficient circumference to permit a human arm proceed therethrough when transport device is worn.

Similarly, transport device 100 may include a first adjustable strap 126 affixed to the third elongated side 106 at a first aperture 114 on the third elongated side 106. Transport device 100 may also include a second adjustable strap 134 affixed to the third elongated side 106 at a second aperture 118 on the third elongated side 104.

In the embodiment shown, first adjustable strap 126 may include a fastener 130. Preferably, the fastener 130 may be affixed to first adjustable strap 126 proximate to the end of the adjustable strap 126 opposite the first aperture 114. Second adjustable strap 134 may included a fastener 138. Preferably, the fastener 138 may be affixed to second adjustable strap 134 proximate to the end of the adjustable strap 134 opposite the second aperture 118. In operation, fastener 128 may be releasably coupled to fastener 134, such that a loop is formed when the fastened together. The loop may be of sufficient circumference to permit a human arm proceed there through when transport device 100 is worn.

More particular, when fastener 128 is releasably connected to fastener 136, a wearer may insert a right arm through the loop that is created. Similarly, when fastener 130 is releasably connected to fastener 139, a wearer may insert a left arm through the loop that is created, In another exemplary embodiment, transport device 100 may further include a third adjustable strap 140 affixed to second elongated side 104 at an end proximate opposite said first adjustable strap 124. Third adjustable strap 140 may be affixed to second elongated side 104 at a third aperture 120. Third adjustable strap 140 may include a third fastener 144, the third fastener 144 affixed to the third adjustable strap 140 opposite third aperture 120.

Transport device 100 may further include a third adjustable strap 142 affixed to third elongated side 106 at an end proximate opposite said first adjustable strap 130. Third adjustable strap 142 may be affixed to third elongated side 106 at a third aperture 122. Third adjustable strap 142 may include a third fastener 146, the third fastener 146 affixed to the third adjustable strap 142 opposite third aperture 122.

During operation, third fastener 144 of the second elongated side 104 may be releasable fastened to third fastener 146 of the third elongated side 106 to form a loop (not shown). For example, a transport device 100 wearer may connect fastener 144 to fastener 146 such that the third adjustable strap 140 and third adjustable strap 142 wrap securely around the wearer's torso.

Transport device 100 further includes means for securing a narrow elongated rod 110 inside open elongated channel 108 for transport. In one exemplary embodiment, means for securing may include multiple binding straps securing the rod tightly against the channel 108. As shown in FIG. 1, transport device 100 may include a first binding strap 164 affixed to the second elongated side 104 at an aperture 148, and may also include a second binding strap 170 affixed to the second elongated side 104 at an aperture 152. In one particular embodiment, binding strap 164 may be position between first adjustable strap 124 and second adjustable strap 132 on the second elongated side 104.

Transport device 100 may include a third binding strap 174 affixed to the second elongated side 104 at an aperture 156, and may also include a fourth binding strap 180 affixed to the second elongated side 104 at an aperture 160. In one particular embodiment, binding strap 164 may be position between first adjustable strap 124 and second adjustable strap 132 on the second elongated side 104.

Transport device 100 may further include a first binding strap 168 affixed to the third elongated side 106 at an aperture 150, and may also include a second binding strap 172 affixed to the third elongated side 106 at an aperture 154. In one particular embodiment, binding strap 168 may be position between first adjustable strap 130 and second adjustable strap 134 on the third elongated side 106.

Transport device 100 may also include a third binding strap 178 affixed to the third elongated side 106 at an aperture 158, and may also include a fourth binding strap 182 affixed to the third elongated side 106 at an aperture 162. In one particular embodiment, binding strap 178 may be position between second adjustable strap 134 and third adjustable strap 132 on the third elongated side 106.

In one embodiment, binding straps 164, 170, 174, 180 may include Velcro pads at one end. Similarly, binding straps 168, 172, 178, 182 may also include Velcro pads that mate with the Velcro pads of binding straps 164, 170, 174, 180. More particularly, binding strap 164 Velcro pad may mate with binding strap 168 Velcro pad, such that binding straps 164 and 168 may be fastened around an elongated object 110 as is done in conventional Velcro techniques. Similarly, binding strap 170 Velcro pad may mate with binding strap 172 Velcro pad, such that binding straps 170 and 172 may be fastened around elongated object 110; binding strap 174 Velcro pad may mate with binding strap 178 Velcro pad, such that binding straps 174 and 178 may be fastened around elongated object 110; and binding strap 180 Velcro pad may mate with binding strap 182 Velcro pad, such that binding straps 180 and 182 may be fastened around elongated object 110.

Figure 1A:
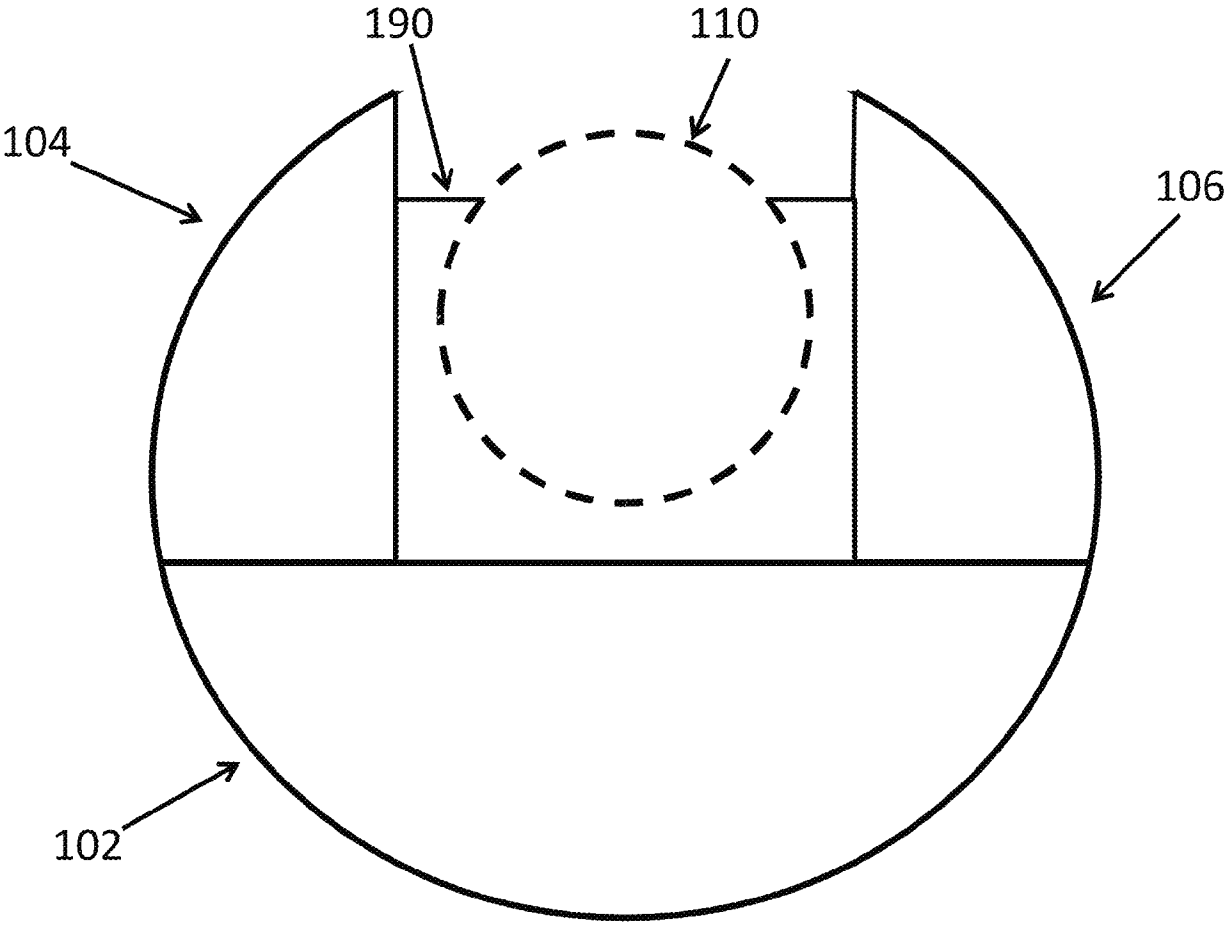
FIG. 1A. depicts is a cross-section of an exemplary embodiment of a transport device according to exemplary embodiments of the present invention.

In another exemplary embodiment, transport device 100 may include a means for absorbing vibrations that may be experienced when transporting elongated object 110. For example, as shown in FIG. 1A, transport device 100 may further include a vibration dampening material 190 interspersed within channel 108. Dampening material may be a suitable material for reducing the effect of movement of elongated object 110 when transported. For example, material 1190 could be a rubber, or foam, or cotton or any such material that reduces movement of elongated object 110 when being transported.

Figure 2:
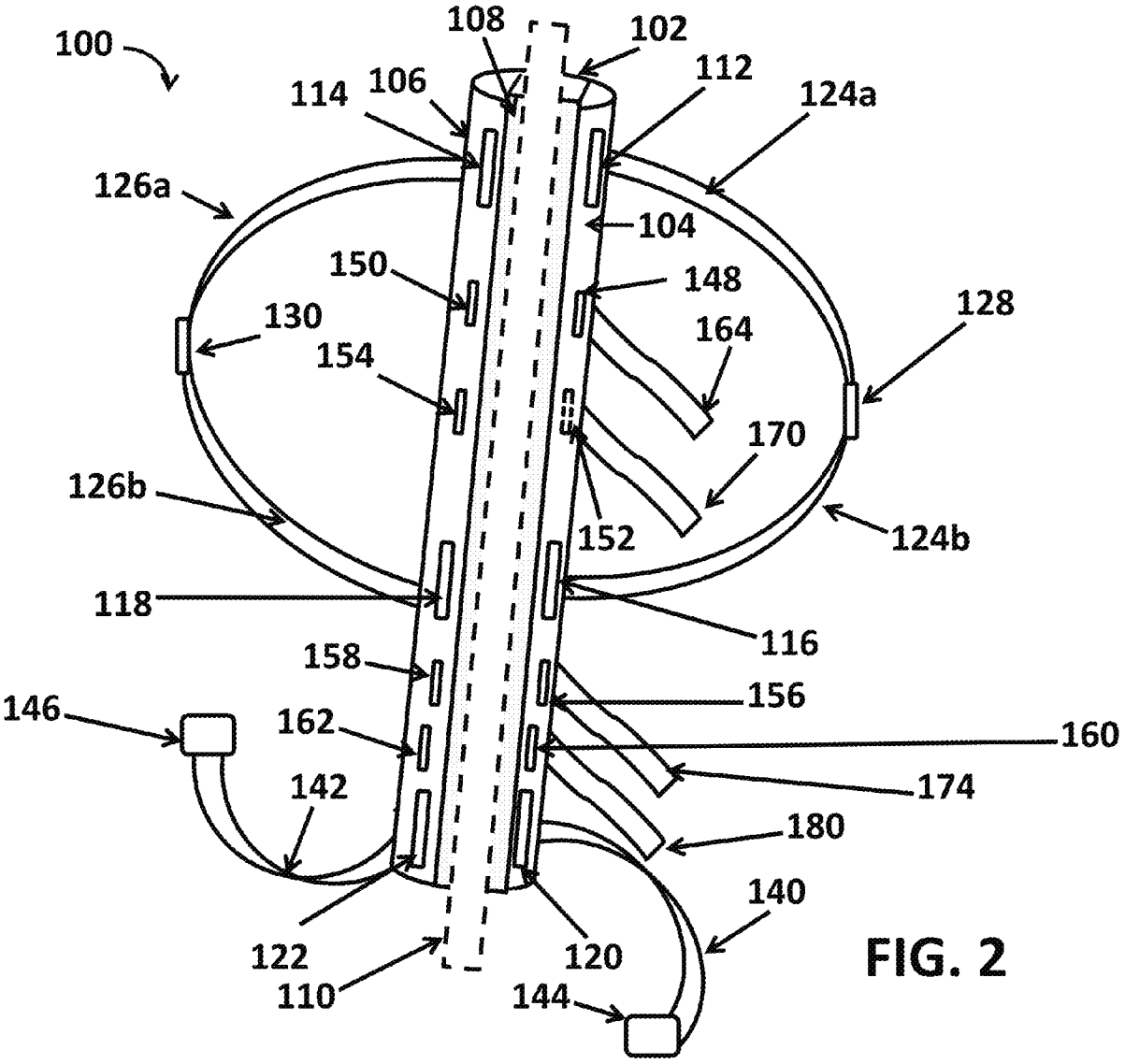
FIG. 2 depicts another exemplary embodiment of a transport device according to the present invention, wherein the transport device includes a reduced number of binding straps.

FIG. 2 depicts another exemplary embodiment of transport device 200 according to the present invention, where in like numerals as seen in FIG. 1 represents like elements in FIG. 2. In this exemplary embodiment, transport device 100 includes a first adjustable strap comprised of a first strap portion 124*a* and a second strap portion 124*b*, wherein first strap portion 124*a* is adjustably connected to said second strap portion 124*b* using for example an adjustable buckle 128.

Transport device 200 may include a second adjustable strap comprised of a first strap portion 126*a* and a second strap portion 126*b*, wherein first strap portion 126*a* is adjustably connected to said second strap portion 126*b* using for example an adjustable buckle 130.

First adjustable strap including a first strap portion 124*a* and a second strap 124*b* may form a loop for inserting a wearer's arm in similar manner as is described with respect to adjustable strap 124 and adjustable strap 132 above. Similarly, second adjustable strap comprised of a first strap portion 126*a* and a second strap portion 126*b* may form a loop fore inserting a wearer's arm in similar manner as described with respect to adjustable strap 126 and adjustable strap 134 above, Transport device 200 may include binding straps on only one elongated side of open channel 108. For example, as depicted in FIG. 2, transport device 200 includes a first binding strap 164 attached at aperture 148 of second elongated side 104; a second binding strap 170 attached at aperture 152 of second elongated side 104; a third binding strap 174 attached at aperture 156 of second elongated side 104; a fourth binding strap 180 attached at aperture 160 of second elongated side 104.

In exemplary embodiments using binding straps on only one side of elongated channel 108, the side of elongated channel 108 opposite the binding straps may include means for attaching the binding straps to the opposite side of the channel 108. For example, third elongated side 106 may include aperture 150 across channel 108 from binding strap 164; third elongates side 106 may also include aperture 154 across channel 108 from binding strap 170; third elongates side 106 may also include aperture 158 across channel 108 from binding strap 174; third elongates side 106 may also include aperture 162 across channel 108 from binding strap 180.

in one particular embodiment, during operation of transport device 200, an elongated object 110 may be secured in channel 108 by for example, looping a binding strap across the elongated object and affixing the bind strap at the aperture. For example, to secure elongated object 110, binding strap 164 may be progressed across channel 108 to adjustable affix at aperture 150. Similarly, elongated object 110 may be further secured in channel 108 during operation when binding straps 170, 174, and 180 may bind the elongated object 110 using apertures 154, 158, and 162, respectfully, in similar manner as is discussed with respect to binding strap 164 and aperture 150.

Figure 3:
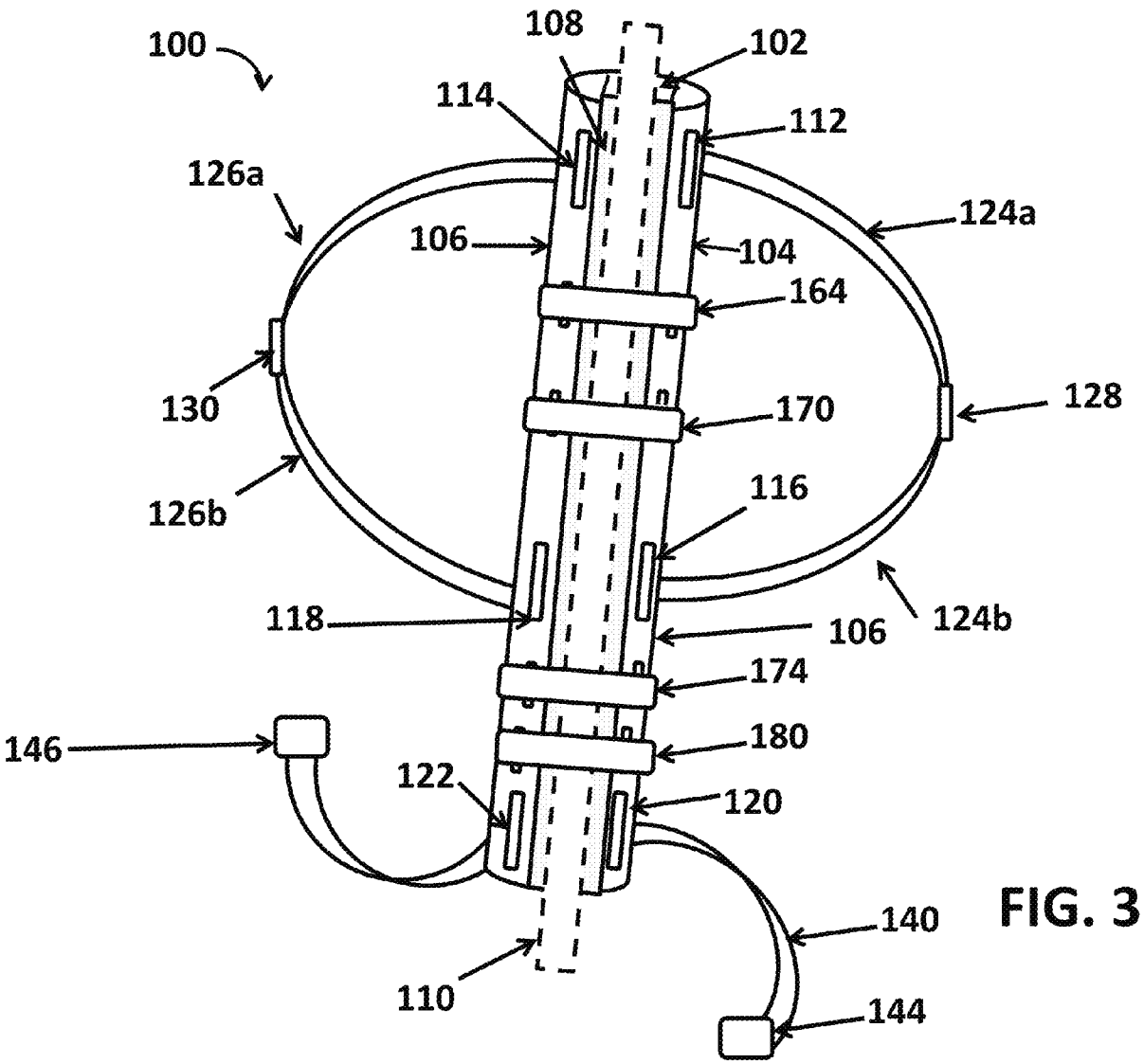
FIG. 3 depicts the transport device securing an elongated narrow object for transport, according to the present invention.

FIG. 3 is an illustration of transport device 200 in operation, wherein binding straps 164, 170, 174, and 180 are shown securing elongated object 110. As shown, the binding straps have traversed the channel 108 to secure elongated object 108. Suitable binding straps that may be used with the invention may use Velcro.

Figure 4:
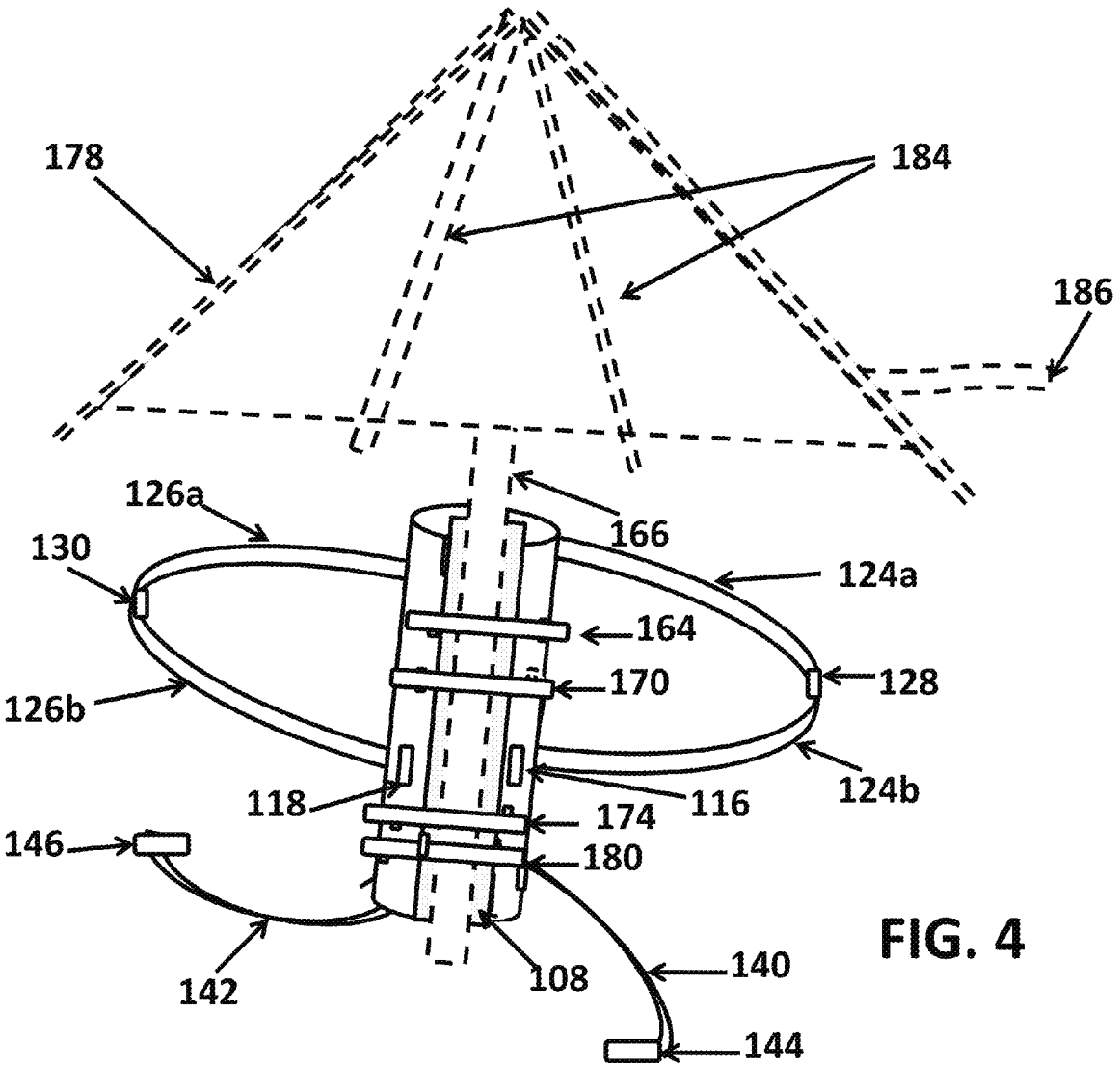
FIG. 4 depicts the transport device securing the elongated narrow rod of an umbrella for transport, according to the present invention.

FIG. 4 depicts a transport device, such as transport device 200 securing the elongated rod of an umbrella shaft 166. Umbrella 116 may be attached to a conventional umbrella, having a canopy 178, supported by umbrella ribs 184. Traditional umbrellas and umbrella elements will not be discussed here for brevity, It is sufficient to note that the current invention is suitable for transporting an umbrella in the manner described above. That is the umbrella shaft 166 is secured in channel 108, such that transport device transports the umbrella.

Figure 5:
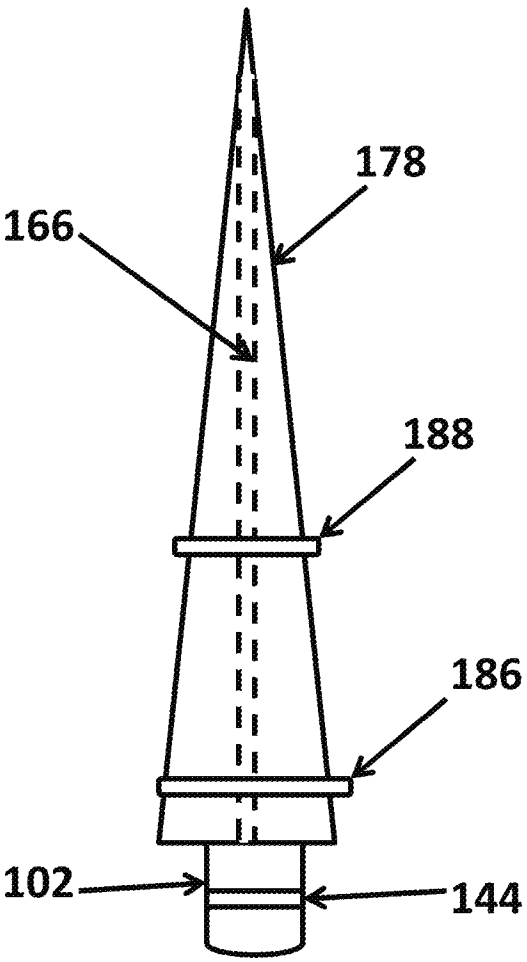
FIG. 5 is a depiction of the transport device securing the elongated narrow rod of an umbrella for transport, according to the present invention, wherein the transport device is secured to the umbrella rod using a canopy.

FIG. 5 depicts the present invention being stored with the umbrella secured to the transport device 200. As can be seen, the umbrella shaft 166 remains secured to transport device 200 using for example, one or more conventional canopy fasteners 188 and 186, In one particular embodiment, canopy fasteners 186 and 188 may be such that they wrap around the umbrella canopy 178. Such canopy fasteners are well known in the art, and will not be discussed herein for brevity.

Figure 6:
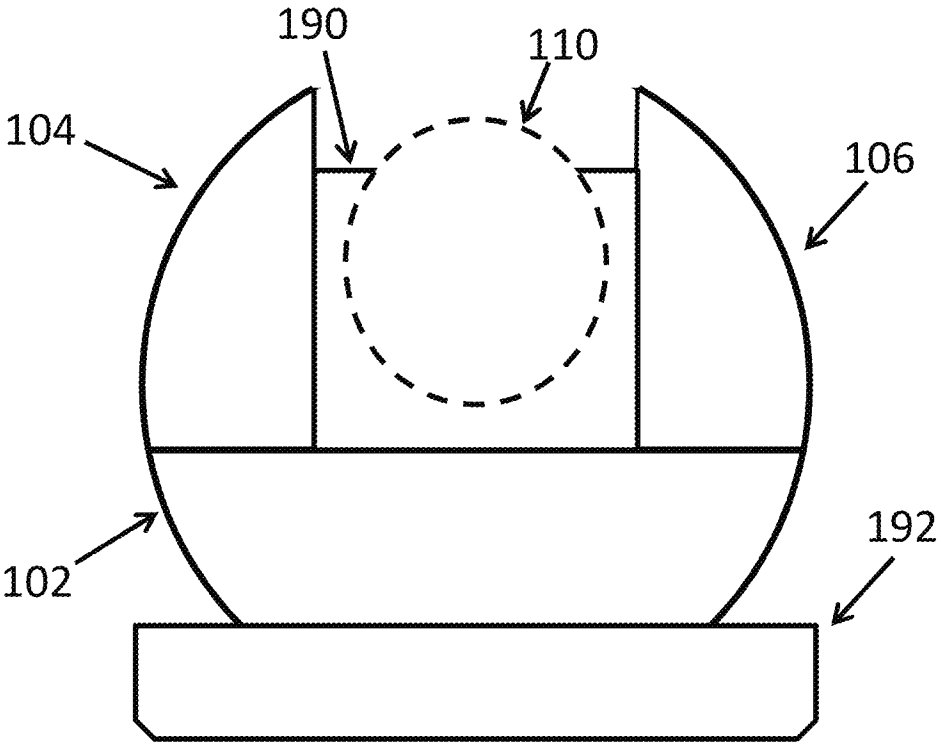
FIG. 6 is a depiction of the transport device securing the elongated narrow rod of an umbrella for transport, according to the present invention, wherein the transport device includes a spine support.
Figure 7:
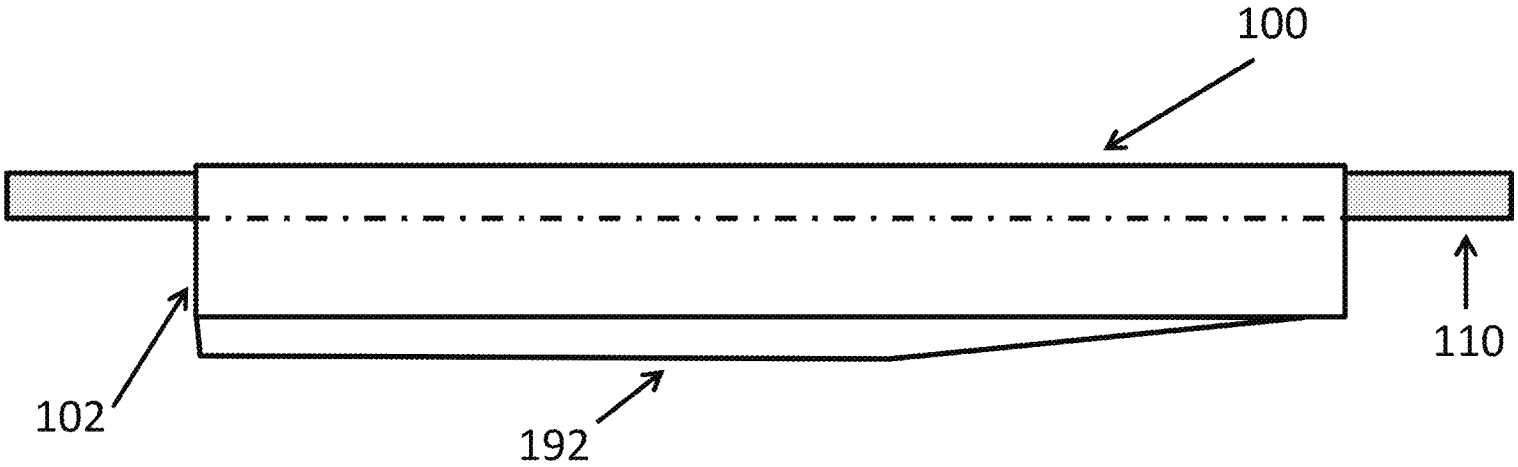
FIG. 7 depicts a longitudinal view of the transport device including a spine support according to exemplary embodiments of the present invention.

In some exemplary embodiments, transport device 100 may include a spine support 192 affixed to the first elongate side 102, as shown in FIG. 6. As shown, spine support 192 may be affixed to first elongated side 102 in proximity to a first end of the first elongated side 102. In operation, the spine support 192 may provide cushion against the elongated object abutting against the wearer's head and/or spine. That is, the spine support 192 may cause the elongated object to be projected away from wearer. The transport device 100 including the spine support may be further seen in the exemplary depiction shown in FIG. 7, wherein like character references represent like elements as is described in FIG. 6.

It should be appreciated by one skilled in art, that the present invention may be utilized in any device that includes hands-free transporting an elongated object. The foregoing description has been directed to specific embodiments of this invention. It will be apparent, however, that other variations and modifications may be made to the described embodiments, with the attainment of some or all of their advantages. Therefore, it is the object of the appended claims to cover all such variations and modifications as come within the true spirit and scope of the invention.

For example, although the transport device is described herein as having three elongated sides, and/or a spine support, it should be understood that in one exemplary embodiment, these elements may form a contiguous transport device. However, it should also be understood, that in another exemplary embodiment, that one or more of the three elongated sided forming the transport may be formed as one portion of the transport device, for example to dampen the vibrations during transport of an elongated object. in such instance, a first elongated sided of the transport device may be constructed to abut a second elongated side of the transport device to reduce vibrations during transport of an elongated object.

What is claimed is:

1. An apparatus for hands-free transport of an elongated narrow object, comprising, a. An open elongated channel having a first elongated side, a second elongated side connected to said first elongated side, and a third elongated side connected to said first elongated side, wherein said second elongated side includes a first aperture on a first end of said second elongated side, wherein said third elongated side includes a first aperture on a first end of said third elongated side, and wherein said first aperture on a first end of said second elongated side is positioned opposite said first aperture on a first end of said third elongated side, wherein said second elongated side includes a second aperture proximate to said first end of said second elongated side, wherein said third elongated side includes a second aperture proximate to said first aperture of said third elongated side, and wherein said second aperture proximate to said first end of said second elongated side is positioned opposite said second aperture on a first end of said third elongated side, wherein said second elongated side includes a third aperture proximate to a second end of said second elongated side, wherein said third elongated side includes a third aperture proximate to a second end of said third elongated side, and wherein said third aperture of said second elongated side is positioned opposite said third aperture of said third elongated side, b. a first adjustable strap affixed to said first aperture of said second elongated side and to said second aperture on said second elongated side, c. a second adjustable strap affixed to said first aperture of said third elongated side and said second adjustable strap affixed to said second aperture on said third elongated side, d. a third adjustable strap affixed to said third aperture of said second elongated side and said third adjustable strap affixed said third aperture on said third elongated side, e. an upper shoulder pad approximate to said first aperture of said second elongated side, said upper shoulder pad approximate to said first aperture of said third elongated side, said upper shoulder pad affixed to said first elongated side, and wherein said open elongated channel includes a malleable material therein.

2. An apparatus according to claim 1, wherein said first adjustable strap comprises a first strap adjustably coupled to a second strap.

3. An apparatus according to claim 1, wherein said second adjustable strap comprises a first strap adjustably coupled to a second strap.

4. An apparatus according to claim 1, wherein said second adjustable strap comprises a first strap adjustably coupled to a second strap.

5. An apparatus according to claim 1, wherein said second elongated side further includes a first binding strap position between said first aperture of said second elongated side and said second aperture of said second elongated side, wherein said second elongated side further includes a second binding strap positioned between said second aperture of said second elongated side and said third aperture of said second elongated side.

6. An apparatus according to claim 5, wherein said third elongated side further includes a first binding strap position between said first aperture of said third elongated side and said second aperture of said third elongated side, wherein said third elongated side further includes a second binding strap positioned between said second aperture of said third elongated side and said third aperture of said third elongated side.

7. An apparatus according to claim 6, wherein said first binding strap of said second elongated side is coupleable to said first binding strap of said third elongated side.

8. An apparatus according to claim 6, wherein said second binding strap of said second elongated side is coupleable to said second binding strap of said third elongated side.

9. An apparatus according to claim 1, wherein said upper shoulder pad is triangular in shape.

10. An apparatus according to claim 1, wherein said first elongated side, said second elongated side and said third elongated side form one single member.

* * * * *